US010808723B2

(12) United States Patent
Nagao et al.

(10) Patent No.: US 10,808,723 B2
(45) Date of Patent: Oct. 20, 2020

(54) ROTARY MACHINE

(71) Applicant: MITSUBISHI HEAVY INDUSTRIES COMPRESSOR CORPORATION, Tokyo (JP)

(72) Inventors: Hideki Nagao, Hiroshima (JP); Masahiro Kobayashi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/487,010

(22) PCT Filed: Feb. 23, 2017

(86) PCT No.: PCT/JP2017/006790
§ 371 (c)(1),
(2) Date: Aug. 19, 2019

(87) PCT Pub. No.: WO2018/154674
PCT Pub. Date: Aug. 30, 2018

(65) Prior Publication Data

US 2020/0232479 A1 Jul. 23, 2020

(51) Int. Cl.
*F04D 29/048* (2006.01)
*F04D 29/58* (2006.01)
(Continued)

(52) U.S. Cl.
CPC ..... *F04D 29/5806* (2013.01); *F04D 29/048* (2013.01); *F04D 29/102* (2013.01); *F04D 29/4206* (2013.01)

(58) Field of Classification Search
None
See application file for complete search history.

(56) References Cited

U.S. PATENT DOCUMENTS 2,620,123 A 12/1952 Parducci
3,217,655 A 11/1965 Sercy et al.
(Continued)

FOREIGN PATENT DOCUMENTS

JP S45-16282 Y1 7/1970
JP S46-33041 B1 9/1971
(Continued)

OTHER PUBLICATIONS

Decision to Grant in corresponding Japanese Application No. 2017-527832, dated Jun. 27, 2017 (7 pages).
(Continued)

*Primary Examiner* — Michael Lebentritt
(74) *Attorney, Agent, or Firm* — Osha Liang LLP

(57) ABSTRACT

A rotary machine includes a thrust bearing and radial bearings rotatably supporting a rotary shaft, a rotation drive portion that rotates the rotary shaft, a first-stage impeller that rotates about an axis of the rotary shaft, a casing, a working fluid gas extraction portion that extracts a working fluid under compression from a middle of the first-stage impeller to an outside of the casing, and a working fluid supply line that allows the working fluid under compression, on which gas extraction is performed by the working fluid gas extraction portion, to be supplied therethrough to the rotation drive portion.

12 Claims, 4 Drawing Sheets

(51) Int. Cl.
*F04D 29/10* (2006.01)
*F04D 29/42* (2006.01)

(56) References Cited

U.S. PATENT DOCUMENTS

| | | | | |
|---|---|---|---|---|
| 4,981,413 | A | 1/1991 | Elonen et al. | |
| 5,123,660 | A * | 6/1992 | Dahlheimer | F16J 15/36 277/374 |
| 7,828,511 | B1 * | 11/2010 | Pinera | F04D 13/043 415/72 |
| 2004/0170505 | A1 | 9/2004 | Lenderink et al. | |
| 2012/0102969 | A1 | 5/2012 | Wagner et al. | |
| 2013/0022460 | A1 * | 1/2013 | Monnot | F04D 29/622 415/230 |
| 2014/0371919 | A1 | 12/2014 | Creamer | |
| 2015/0016981 | A1 * | 1/2015 | Sano | F04D 29/684 415/206 |
| 2015/0240833 | A1 | 8/2015 | Bigi et al. | |
| 2015/0260191 | A1 * | 9/2015 | Blankemeier | F04D 13/025 417/420 |
| 2017/0009810 | A1 * | 1/2017 | Futae | F02B 39/14 |
| 2017/0074278 | A1 * | 3/2017 | Watanabe | F01D 9/026 |
| 2018/0080456 | A1 * | 3/2018 | Masutani | F04D 29/083 |
| 2019/0040863 | A1 * | 2/2019 | Davis | F04D 13/08 |

FOREIGN PATENT DOCUMENTS

| | | | |
|---|---|---|---|
| JP | H5-223090 | A | 8/1993 |
| JP | H11-13686 | A | 1/1999 |
| JP | 2004-527693 | A | 9/2004 |
| JP | 2013-194687 | A | 9/2013 |
| WO | 2017-015729 | A1 | 2/2017 |

OTHER PUBLICATIONS

International Search Report and Written Opinion in corresponding International Application No. PCT/JP2017/006790, dated Apr. 18, 2017 (14 pages).

* cited by examiner

ROTARY MACHINE

TECHNICAL FIELD

The present invention relates to a rotary machine.

BACKGROUND ART

As one type of rotary machine, a centrifugal compressor is known in the art. The centrifugal compressor has a rotary shaft, an impeller, a rotation drive portion that rotates the rotary shaft, and a casing that accommodates the rotary shaft, a rotating impeller, and a rotation drive portion. The impeller is provided on the rotary shaft, and rotates with the rotary shaft. The impeller compresses a fluid introduced in an inlet, and discharges the compressed fluid from an outlet.

A centrifugal compressor that cools an electric motor (a rotation drive portion) by using a working fluid of which compression is completed by an impeller as a working fluid for cooling is disclosed in PTL 1.

CITATION LIST

Patent Document

Patent Document 1: Published Japanese Translation No. 2004-527693 of the PCT International Publication

SUMMARY OF INVENTION

Technical Problem

However, the pressure and the temperature of the working fluid of which compression is completed by the impeller (the working fluid discharged from an outlet of the impeller) become high as the working fluid is compressed. For this reason, if the working fluid of which compression is completed by the impeller (hereinafter, referred to as a "compression-completed working fluid") is used as a working fluid for cooling, a large amount of the compression-completed working fluid is necessary in order to cool the electric motor. Therefore, there is a possibility that efficiently cooling the electric motor (the rotation drive portion) becomes difficult.

Thus, an object of the present invention is to provide a rotary machine that can efficiently cool the rotation drive portion.

Solution to Problem

According to a first aspect of the present invention, a rotary machine includes: a bearing configured to rotatably support a rotary shaft; a rotation drive portion configured to rotate the rotary shaft; an impeller that is provided on the rotary shaft, and configured to be rotated about an axis of the rotary shaft thereby compressing a working fluid flowing therein; a casing accommodating the rotary shaft, the bearing, the rotation drive portion and the impeller; a working fluid gas extraction portion configured to extract the working fluid under compression from a middle of the impeller to an outside of the casing; and a working fluid supply line configured to allow the working fluid under compression, on which gas extraction is performed by the working fluid gas extraction portion, to be supplied therethrough to the rotation drive portion.

Since the working fluid gas extraction portion that performs gas extraction on the working fluid under compression from the middle of the impeller to the outside of the casing and the working fluid supply line that allows the working fluid under compression, on which gas extraction is performed, to be supplied therethrough to the rotation drive portion are included as described above, it is possible to make the temperature of the working fluid low compared to a case where the compressed working fluid which has passed through the impeller is used. Accordingly, the rotation drive portion can be efficiently cooled by making the amount of the working fluid necessary for cooling the rotation drive portion small.

According to a second aspect of the present invention, the rotary machine may further include: a working fluid supply line for an impeller configured to allow the working fluid to be supplied therethrough to an inlet of the impeller; and a working fluid recovery line that is connected to the working fluid supply line for an impeller, the working fluid under compression, which is supplied through the working fluid supply line, is allowed to be recovered through the working fluid recovery line, and the working fluid under compression, which is supplied to the rotation drive portion through the working fluid supply line for an impeller, is allowed to be supplied to the inlet of the impeller through the working fluid recovery line.

Since the temperature of a working fluid under compression on which gas extraction is performed from the middle of the impeller is low compared to the compressed working fluid of which compression is completed by the impeller, it is possible to make the amount of a working fluid necessary for cooling the rotation drive portion small. Accordingly, the amount of the working fluid to be collected through the working fluid collection line is small. Therefore, since it is possible to make the amount of the working fluid to be compressed by the impeller small, the power of the impeller can be made small.

However, since gas extraction is performed on the working fluid under compression from the middle of the impeller to the outside of the casing, the pressure of the used working fluid under compression decreases. However, the pressure of the working fluid under compression that is in a state where the pressure thereof has decreased is higher than the pressure of the working fluid that is supplied through the working fluid supply line for an impeller and is not compressed. Accordingly, the collected working fluid under compression can be supplied to the inlet of the impeller via the working fluid supply line for an impeller without using an additional pressure-boosting device.

Using a working fluid that is not compressed, instead of the working fluid under compression, is also considered. In this case, however, since the pressure of the used working fluid that is not compressed is even lower than the pressure of a working fluid that flows in the working fluid supply line for an impeller and is not compressed, it is necessary to provide an additional pressure-boosting device. Thus, this is not preferable since costs increase.

In the rotary machine according to a third aspect of the present invention, the impeller may include a disk portion fixed to the rotary shaft, a plurality of blade portions that are arranged in a circumferential direction of the disk portion and are erected on the disk portion, and a shroud portion covering the plurality of blade portions and opposes an inner surface of the casing. A plurality of seal portions may be provided between the shroud portion and the inner surface of the casing so as to be arranged to be spaced apart from each other in a direction from the inlet toward an outlet of the impeller. The working fluid gas extraction portion may include a first penetration portion that is formed so as to penetrate the shroud portion to reach a gap formed between the two seal portions adjacent to each other and a second penetration portion that is formed so as to penetrate the casing to reach the gap, and is connected to the working fluid supply line.

Since the first penetration portion that penetrates the shroud portion and reaches the gap formed between the two seal portions adjacent to each other is included as described above, it is possible to perform gas extraction on a working fluid under compression in the gap. In addition, since the second penetration portion that penetrates the casing, reaches the gap, and is connected to the working fluid supply line is included as described above, it is possible to lead the working fluid under compression on which gas extraction is performed by the first penetration portion to the outside of the casing. Accordingly, the working fluid under compression can be led into the working fluid supply line.

In the rotary machine according to a fourth aspect of the present invention, the gap may be a ring-shaped surrounding the rotary shaft. A plurality of flow passages may be formed by defining spaces between the shroud portion and the disk portion by the plurality of blade portions in a circumferential direction of the rotary shaft. The first penetration portion may be provided with respect to each of the plurality of flow passages.

By making the gap ring-shaped and providing one first penetration portion with respect to each of the plurality of flow passages as described above, gas extraction can be evenly performed on the working fluid under compression from each of the flow passages. Thus, variations in the flow of each flow passage inside the impeller are prevented, and thereby a decrease in performance can be suppressed.

In the rotary machine according to a fifth aspect of the present invention, the impeller may include a disk portion fixed to the rotary shaft, a plurality of blade portions that are arranged in a circumferential direction of the disk portion and are erected on a first surface of the disk portion, and a shroud portion covering the plurality of blade portions so as to oppose an inner surface of the casing. The rotary machine may further includes a shaft seal member that is provided between the rotary shaft and the casing so as to be disposed on a disk side of an axis direction of the rotary shaft with respect to the impeller, and a seal portion that is provided between the disk portion and the casing so as to form a space between the shaft seal member and the seal portion. The working fluid gas extraction portion may include a first penetration portion that is formed so as to penetrate the disk portion to reach the space, and a second penetration portion that is formed so as to penetrate the casing to reach the space, and is connected to the working fluid supply line.

Since the first penetration portion that penetrates the disk portion and reaches the space formed between the shaft seal member and the seal portion is included as described above, it is possible to perform gas extraction on a working fluid under compression in the gap. In addition, since the second penetration portion that penetrates the casing, reaches the space, and is connected to the working fluid supply line is included as described above, it is possible to lead the working fluid under compression on which gas extraction is performed by the first penetration portion to the outside of the casing. Accordingly, the working fluid under compression can be led into the working fluid supply line.

In the rotary machine according to a sixth aspect of the present invention, the space may be a ring-shaped surrounding the rotary shaft. A plurality of flow passages arranged in the circumferential direction of the rotary shaft may be defined by the plurality of blade portions. The first penetration portion may be provided with respect to each of the plurality of flow passages.

By making the space ring-shaped and providing one first penetration portion with respect to each of the plurality of flow passages as described above, gas extraction can be evenly performed on the working fluid under compression from each of the flow passages. Thus, variations in the flow of each flow passage inside the impeller are prevented, and thereby a decrease in performance can be suppressed.

In the rotary machine according to a seventh aspect of the present invention, a plurality of the impellers may be provided in an axis direction of the rotary shaft. The working fluid under compression may be extracted by the working fluid gas extraction portion from a first-stage impeller that initially compressing the working fluid, out of the plurality of impellers.

By performing gas extraction on the working fluid under compression from the first-stage impeller that initially compresses the working fluid, out of the plurality of impellers provided in the axis direction of the rotary shaft as described above, it is possible to make the temperature of the working fluid low compared to a case where the gas extraction is performed on the working fluid under compression from an impeller other than the first-stage impeller. Accordingly, the rotation drive portion can be efficiently cooled by making the amount of the working fluid necessary for cooling the rotation drive portion small.

In the rotary machine according to an eighth aspect of the present invention, the bearing may be a working fluid bearing, and the working fluid under compression may be allowed to be supplied to the working fluid bearing through the working fluid supply line.

Since the working fluid supply line that allows the working fluid under compression to be supplied therethrough to the working fluid bearing is included as described above, the working fluid under compression can be used as a working fluid of the working fluid bearing.

In the rotary machine according to a ninth aspect of the present invention, the bearing may be a magnetic bearing, and the working fluid under compression may be allowed to be supplied to the magnetic bearing through the working fluid supply line.

Since the working fluid supply line that allows the working fluid under compression to be supplied therethrough to the magnetic bearing is included as described above, the magnetic bearing can be cooled.

ADVANTAGEOUS EFFECTS OF INVENTION

According to the present invention, the rotary machine that can efficiently cool the rotation drive portion is provided.

DESCRIPTION OF EMBODIMENTS

First Embodiment

Figure 1:
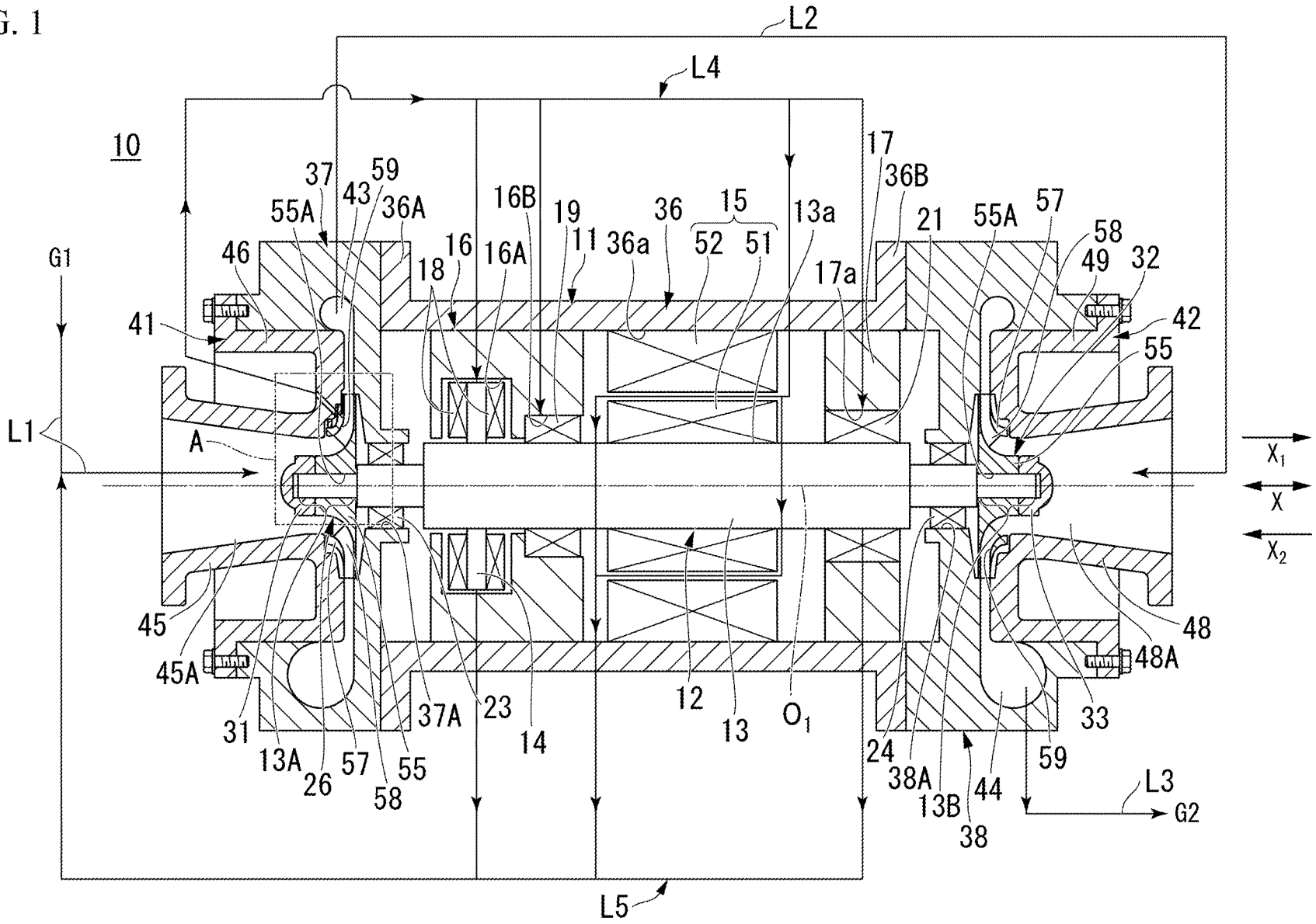
FIG. 1 is a sectional view schematically illustrating a simplified configuration of a rotary machine according to a first embodiment of the present invention.

FIG. 1 is a sectional view schematically illustrating a simplified configuration of a rotary machine according to a first embodiment of the present invention. In FIG. 1, $X_1$ indicates a direction from a first-stage impeller 26 toward a second-stage impeller 32, $X_2$ indicates a direction from the second-stage impeller 32 toward the first-stage impeller 26, an X-direction indicates a thrust direction (an extension direction of a rotary shaft main body 13), $O_1$ indicates an axis of the rotary shaft 12 extending in the X-direction (hereinafter, referred to as an "axis $O_1$"), G1 indicates a working fluid that is not compressed, and G2 indicates a second-stage compressed working fluid.

Figure 2:
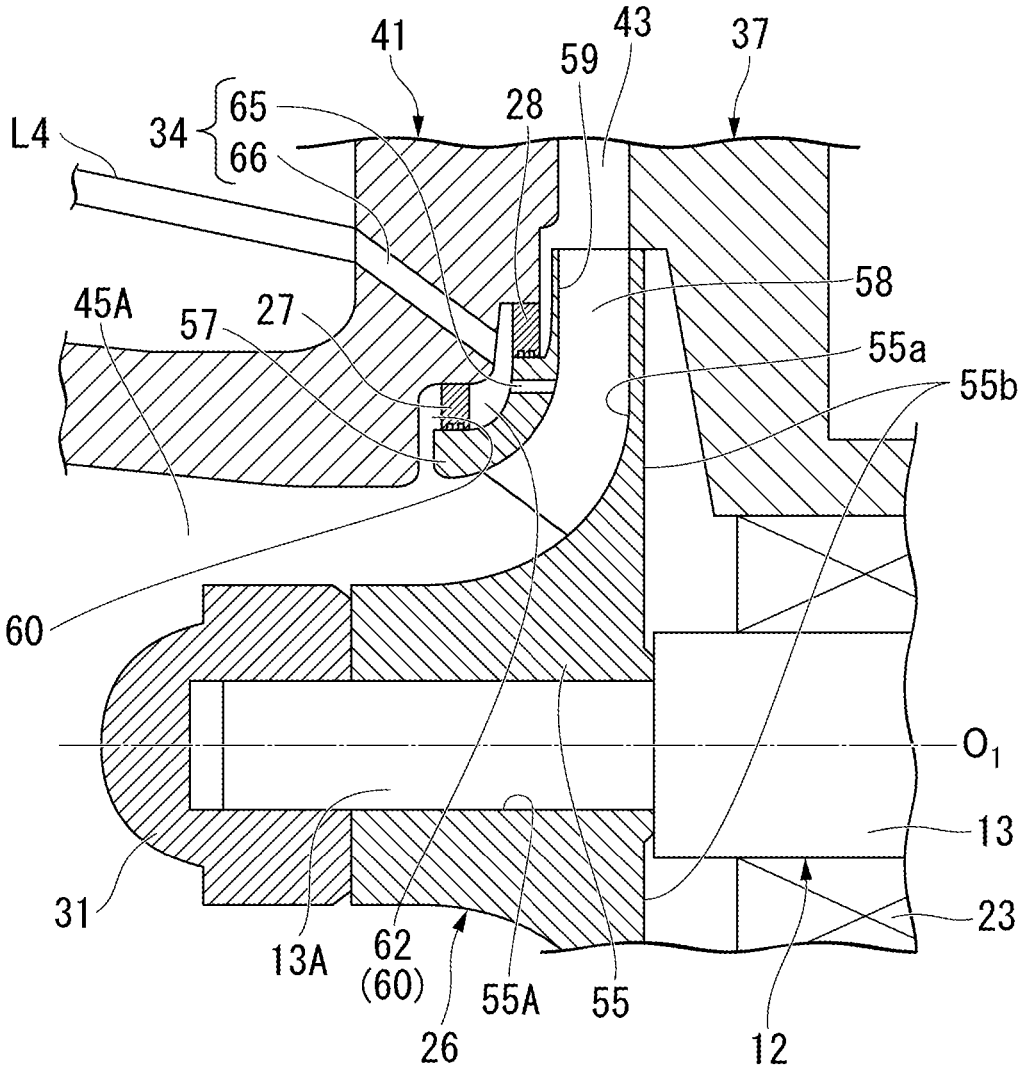
FIG. 2 is an enlarged sectional view of a portion of the rotary machine illustrated in FIG. 1, which is surrounded by a region A.
Figure 3:
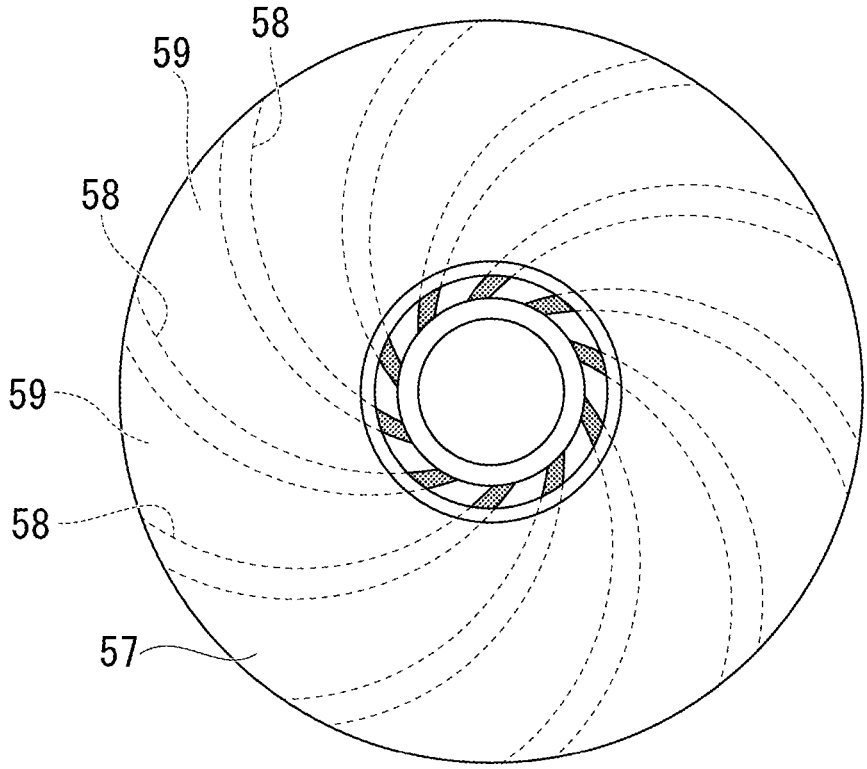
FIG. 3 is a plan view of a first-stage impeller illustrated in FIG. 1, which is seen from a disk portion side.

FIG. 2 is an enlarged sectional view of a portion of the rotary machine illustrated in FIG. 1, which is surrounded by a region A. In FIG. 2, the same configuring portions as the structures illustrated in FIG. 1 are assigned with the same reference signs. FIG. 3 is a plan view of the first-stage impeller illustrated in FIG. 1, which is seen from a disk portion side. In FIG. 3, the same configuring portions as the structures illustrated in FIG. 2 are assigned with the same reference signs.

A rotary machine 10 of the first embodiment will be described with reference to FIGS. 1 to 3. The rotary machine 10 has a casing 11, the rotary shaft 12, a rotation drive portion 15, bearing-supporting members 16 and 17, a thrust bearing 18, radial bearings 19 and 21, shaft seal members 23 and 24, the first-stage impeller 26, seal portions 27 and 28, position-regulating portions 31 and 33, the second-stage impeller 32, a working fluid gas extraction portion 34, a working fluid supply line for impeller L1, a first-stage compressed working fluid supply line L2, a second-stage compressed working fluid supply line L3, a working fluid supply line L4, and a working fluid collection line L5.

The casing 11 accommodates the rotary shaft 12, the rotation drive portion 15, the bearing-supporting members 16 and 17, the thrust bearing 18, the radial bearings 19 and 21, the shaft seal members 23 and 24, the first-stage impeller 26, the seal portions 27 and 28, the position-regulating portions 31 and 33, and the second-stage impeller 32.

The casing 11 has a first casing portion 36, second casing portions 37 and 38, third casing portions 41 and 42, and flow passages 43 and 44.

The first casing portion 36 is a tubular member of which both ends are open ends. The first casing portion 36 extends in the X-direction. A first flange portion 36A is provided on one end of the first casing portion 36. A second flange portion 36B is provided on the other end of the first casing portion 36.

The second casing portion 37 is fixed to the first flange portion 36A. An opening portion 37A into which one end portion 13A of the rotary shaft main body 13 is inserted is provided in a middle portion of the second casing portion 37. The second casing portion 38 is fixed to the second flange portion 36B. An opening portion 38A into which the other end portion 13B of the rotary shaft main body 13 is inserted is provided in a middle portion of the second casing portion 38.

The third casing portion 41 has a first working fluid-introducing portion 45 and a supporting portion 46. The first working fluid-introducing portion 45 is a tubular member, and extends in the X-direction. The first working fluid-introducing portion 45 has a space 45A of which an inside is cylindrical.

A working fluid that is not compressed, a working fluid under compression, which is collected through the working fluid collection line L5, and a working fluid obtained by mixing these working fluids together are supplied to the space 45A via the working fluid supply line for impeller L1. The third casing portion 41 is provided at a position where the first working fluid-introducing portion 45 can accommodate the one end portion 13A of the rotary shaft main body 13.

The supporting portion 46 is provided on the other end of the first working fluid-introducing portion 45. The supporting portion 46 has a shape spreading to the outside of the first working fluid-introducing portion 45. A part of the supporting portion 46 is in contact with the second casing portion 37. The supporting portion 46 is fixed to the second casing portion 37 by a bolt or the like.

The third casing portion 42 has a second working fluid-introducing portion 48 and a supporting portion 49. The second working fluid-introducing portion 48 is a tubular member, and extends in the X-direction. The second working fluid-introducing portion 48 has a space 48A of which an inside is cylindrical. A compressed working fluid of which compression is completed by the first-stage impeller 26 (hereinafter, referred to as a "first-stage compressed working fluid") is introduced into the space 48A. The third casing portion 42 is provided at a position where the second working fluid-introducing portion 48 can accommodate the other end portion 13B of the rotary shaft main body 13.

The supporting portion 49 is provided on the other end of the second working fluid-introducing portion 48. The supporting portion 49 has a shape spreading to the outside of the second working fluid-introducing portion 48. A part of the supporting portion 49 is in contact with the second casing portion 38. The supporting portion 49 is fixed to the second casing portion 38 by a bolt or the like.

The flow passage 43 is formed between the second casing portion 37 and the third casing portion 41. The first-stage compressed working fluid of which compression is completed by the first-stage impeller 26 is discharged to the flow passage 43. The first-stage compressed working fluid discharged to the flow passage 43 is supplied to the space 48A via the first-stage compressed working fluid supply line L2.

The rotary shaft 12 includes the rotary shaft main body 13 and a thrust collar 14. The rotary shaft main body 13 is accommodated in the casing 11 in a state of extending in the X-direction. For example, the rotary shaft main body 13 may have a cylindrical shape. The rotary shaft main body 13 is supported by the radial bearings 19 and 21 in a rotatable state. The rotary shaft main body 13 has the one end portion 13A and the other end portion 13B.

The one end portion 13A is a portion into which the first-stage impeller 26 is inserted. The diameter of the one end portion 13A is smaller than other portions of the rotary shaft main body 13 excluding the other end portion 13B. Accordingly, it is possible to regulate the position of the first-stage impeller 26 in the $X_1$-direction.

The other end portion 13B is a portion into which the second-stage impeller 32 is inserted. The diameter of the other end portion 13B is smaller than other portions of the rotary shaft main body 13 excluding the one end portion 13A. Accordingly, it is possible to regulate the position of the second-stage impeller 32 in the $X_2$-direction.

The thrust collar 14 is provided on an outer circumferential surface 13*a* of a portion positioned on a one end portion 13A side of the rotary shaft main body 13. The thrust collar 14 is a ring-shaped member erected on the outer circumferential surface 13*a*. The thrust collar 14 is integrally formed with the rotary shaft main body 13.

The rotation drive portion 15 has a rotor 51 and a stator 52. The rotor 51 is fixed to the outer circumferential surface 13*a* of a middle portion of the rotary shaft main body 13. The stator 52 is provided on an inner circumferential surface 36*a* of the first casing portion 36, which opposes the rotor 51. By rotating the rotor 51, the rotation drive portion 15 rotates the rotary shaft main body 13 with the rotor 51.

The bearing-supporting member 16 is a ring-shaped member surrounding the rotary shaft main body 13, and is accommodated in the first casing portion 36. The bearing-supporting member 16 is disposed between the first-stage impeller 26 and the rotation drive portion 15. The bearing-supporting member 16 is fixed to an inside of the first casing portion 36.

The bearing-supporting member 16 has a ring-shaped accommodation portion 16A and a ring-shaped hollow portion 16B. The ring-shaped accommodation portion 16A is provided on an outer circumferential surface 13*a* side of the rotary shaft main body 13. The ring-shaped accommodation portion 16A accommodates the thrust collar 14 and the thrust bearing 18.

The ring-shaped hollow portion 16B is provided on the outer circumferential surface 13*a* side of the rotary shaft main body 13. The ring-shaped hollow portion 16B is disposed between the ring-shaped accommodation portion 16A and the rotation drive portion 15. The radial bearing 19 is disposed in the ring-shaped hollow portion 16B.

The bearing-supporting member 17 is a ring-shaped member surrounding the rotary shaft main body 13, and is accommodated in the first casing portion 36. The bearing-supporting member 17 is disposed between the second-stage impeller 32 and the rotation drive portion 15. The bearing-supporting member 17 is fixed to the inside of the first casing portion 36.

The thrust bearing 18 is disposed to sandwich both surfaces of the thrust collar 14 (two surfaces disposed in the X-direction) therein in the X-direction. The thrust bearing 18 suppresses displacement of the position of the rotary shaft 12 in the X-direction by supporting the thrust collar 14. It is possible to use, for example, a magnetic bearing, an oil bearing, a working fluid bearing, and the like as the thrust bearing 18.

The radial bearing 19 is disposed in the ring-shaped hollow portion 16B. The radial bearing 21 is provided on an inner circumferential surface 17*a* of the bearing-supporting member 17. The radial bearing 19 rotatably supports the rotary shaft main body 13. It is possible to use, for example, a magnetic bearing, an oil bearing, a working fluid bearing, and the like as the radial bearings 19 and 21.

The shaft seal member 23 is provided at a portion of the second casing portion 37, which defines the opening portion 37A. The shaft seal member 24 is provided at a portion of the second casing portion 38, which defines the opening portion 38A. The shaft seal members 23 and 24 are shaft seals that seal between the rotary shaft main body 13 and the second casing portions 37 and 38.

The first-stage impeller 26 has a disk portion 55, a plurality of blade portions 58, a shroud portion 57, and flow passages 59.

A through-hole 55A is formed in the middle of the disk portion 55. The one end portion 13A of the rotary shaft main body 13 is inserted in the through-hole 55A. The first-stage impeller 26 is disposed at the one end portion 13A of the rotary shaft main body 13. Accordingly, the first-stage impeller 26 rotates about the axis $O_1$ of the rotary shaft 12 when the rotary shaft 12 rotates.

The disk portion 55 has a first surface 55*a*, which is a curved surface, and a second surface 55*b*. The first surface 55*a* is a surface where the plurality of blade portions 58 are formed. The second surface 55*b* is a surface disposed on an opposite side to the first surface 55*a*. A part of the second surface 55*b* opposes the shaft seal member 23.

In a state where predetermined intervals are placed in a circumferential direction of the disk portion 55, the plurality of blade portions 58 are erected on the first surface 55*a* of the disk portion 55. The plurality of blade portions 58 define the plurality of flow passages 59 arranged in a circumferential direction of the rotary shaft 12.

The shroud portion 57 is provided on the plurality of blade portions 58 such that the plurality of blade portions 58 are sandwiched between the disk portion 55 and the shroud portion. Accordingly, the shroud portion 57 covers the plurality of blade portions 58. A ring-shaped gap 60 for suppressing contact between the rotating first-stage impeller 26 and the third casing portion 41 is formed between the shroud portion 57 and the third casing portion 41 in the X-direction.

Each of the flow passages 59 is defined by the disk portion 55, the shroud portion 57, and the two blade portions 58 adjacent to each other. The plurality of flow passages 59 are formed in the circumferential direction of the disk portion 55. The flow passages 59 are connected to the space 45A and the flow passage 43.

A working fluid that is not compressed, a working fluid under compression, which is collected through the working fluid collection line L5, or a working fluid obtained by mixing these working fluids together is introduced into inlets of the flow passages 59. These working fluids are compressed by passing through the flow passages 59 of the rotating first-stage impeller 26. The compressed first-stage compressed working fluid is discharged to the flow passage 43 via outlets of the flow passages 59.

The seal portion 27 is provided at a position where a portion of the gap 60 formed between the shroud portion 57 and the third casing portion 41, which is positioned on an inlet side of the flow passages 59, can be sealed. The seal portion 27 suppresses flowing of the first-stage compressed working fluid having a pressure higher than a working fluid existing on the inlet side of the flow passages 59 to the inlet side of the flow passages 59 through the gap 60.

The seal portion 28 is provided at a position where a portion of the gap 60, which is positioned on an outlet side of the flow passages 59, can be sealed. A ring-shaped gap 62 (a gap configuring a part of the gap 60) is defined between the seal portion 28 and the seal portion 27. The seal portions 27 and 28 are provided in a state of being spaced apart from each other in a direction from an inlet toward an outlet of the first-stage impeller 26. The seal portions 27 and 28 are two seal portions adjacent to each other. It is possible to use, for example, a labyrinth seal, a hole pattern seal, a leaf seal, an abradable seal, and the like as the seal portions 27 and 28.

The position-regulating portion 31 is provided on one end of the rotary shaft main body 13 protruding from the first-stage impeller 26. The position-regulating portion 31 regulates the movement of the first-stage impeller 26 in the $X_2$-direction.

The second-stage impeller 32 has the same configuration as the first-stage impeller 26 described above. That is, the second-stage impeller 32 has the disk portion 55, the shroud portion 57, the plurality of blade portions 58, and the flow passages 59.

The second-stage impeller 32 is provided at the other end portion 13B of the rotary shaft main body 13 in a state where the other end portion 13B of the rotary shaft main body 13 is inserted in the through-hole 55A. Accordingly, the second-stage impeller 32 rotates about the axis $O_1$ of the rotary shaft 12 when the rotary shaft 12 rotates.

The first-stage compressed working fluid is supplied to the inlets of the flow passages 59 configuring the second-stage impeller 32 through a line L2. By compressing the first-stage compressed working fluid, a second-stage compressed working fluid having a higher temperature and a higher pressure than the first-stage compressed working fluid is generated by the second-stage impeller 32. The second-stage compressed working fluid is discharged from the outlets of the flow passages 59 configuring the second-stage impeller 32 to the flow passage 44.

The position-regulating portion 33 is provided on the other end of the rotary shaft main body 13 protruding from the second-stage impeller 32. The position-regulating portion 33 regulates the movement of the second-stage impeller 32 in the $X_1$-direction.

The working fluid gas extraction portion 34 has a first penetration portion 65 and a second penetration portion 66. The first penetration portion 65 penetrates the shroud portion 57 positioned between the two blade portions 58 provided at positions adjacent to each other. The first penetration portion 65 has one end that communicates with a middle position in the flow passage 59 and the other end that reaches the gap 62. Accordingly, the first penetration portion 65 allows the flow passages 59 to communicate with the gap 62.

The first penetration portion 65 performs gas extraction on a working fluid under compression by the first-stage impeller 26 from the first-stage impeller 26, and leads the working fluid under compression on which gas extraction is performed to the gap 62. Accordingly, the pressure of the gap 62 (hereinafter, referred to as a "third pressure") is a pressure between the pressure of the space 45A formed outside the seal portion 27 (hereinafter, referred to as a "first pressure") and the pressure of the flow passage 43 formed outside the seal portion 28 (hereinafter, referred to as a "second pressure"). The working fluid of which compression is completed by the first-stage impeller 26 flows in the gap 60 and the flow passage 43 formed outside the seal portion 28. For this reason, the second pressure is higher than the first pressure.

As described above, since the two seal portions 27 and 28 defining the ring-shaped gap 62 and the first penetration portion 65 that performs gas extraction on a working fluid under compression from the first-stage impeller 26 to the gap 62 are included, it is possible to make the third pressure of the gap 62 disposed between the space 45A having the first pressure (low pressure) and the flow passage 43 having the second pressure (high pressure) a pressure between the first pressure and the second pressure (intermediate pressure).

Accordingly, a region having the first pressure (high pressure) and a region having the third pressure (intermediate pressure), between which the seal portion 27 is sandwiched, are disposed, and a region having the second pressure (high pressure) and the region having the third pressure (intermediate pressure), between which the seal portion 28 is sandwiched, are disposed.

Therefore, it is possible to make a pressure difference between both of the seal portions 27 and 28 small compared to a case where only the seal portion 27 seals between the region having the first pressure and the region having the second pressure. Accordingly, the sealing performance of the seal portions 27 and 28 can be increased.

It is possible to dispose the first penetration portion 65, for example, in a portion corresponding to a middle position in the blade portions 58 in a working fluid flowing direction. The first penetration portion 65 may be provided, for example, with respect to each of the plurality of flow passages 59.

By providing the first penetration portion 65 with respect to each of the plurality of flow passages 59 to communicate with the ring-shaped gap 62 as described above, gas extraction can be performed on a working fluid under compression from each of the flow passages 59.

The working fluid supplied to the inlets of the flow passages 59 tends to flow to a side close to an inner surface of the shroud portion 57 and to be compressed. Therefore, gas extraction can be efficiently performed on a working fluid under compression by providing the first penetration portion 65 in the shroud portion 57.

It is possible to use, for example, a through-hole as the aforementioned first penetration portion 65. In a case where a through-hole extending in a predetermined direction is used as the first penetration portion 65, the through-hole may extend in a direction parallel to the axis $O_1$, or may extend in a direction inclined to an axis $O_1$ direction (an intersecting direction).

The second penetration portion 66 is provided to penetrate the third casing portion 41. The second penetration portion 66 has one end that reaches the gap 62 and the other end connected to the working fluid supply line L4. The second penetration portion 66 allows a working fluid under compression, on which gas extraction is performed by the first penetration portion 65, to be introduced into the working fluid supply line L4.

It is possible to use, for example, a through-hole as the second penetration portion 66. In a case where a through-hole is used as the second penetration portion 66, it is possible to set an extension direction of the through-hole as appropriate. It is possible to select the number of the second penetration portion 66 as appropriate according to a purpose, and the number may be, for example, one.

The working fluid supply line for impeller L1 has one end connected to a working fluid supply source (not illustrated) that supplies a working fluid that is not compressed and the other end connected to the first working fluid-introducing portion 45. A working fluid that is supplied from the working fluid supply source (not illustrated) and is not compressed (a low-temperature and low-pressure working fluid) is supplied to the space 45A through the working fluid supply line for impeller L1. The working fluid supplied to the space 45A is compressed by the first-stage impeller 26.

The first-stage compressed working fluid supply line L2 has one end connected to the flow passage 43 and the other end connected to the second working fluid-introducing portion 48. The first-stage compressed working fluid discharged to the flow passage 43 is supplied into the space 48A through the first-stage compressed working fluid supply line L2. The first-stage compressed working fluid supplied to the space 48A is further compressed by the second-stage impeller 32, becomes a high-temperature and high-pressure second-stage compressed working fluid, and is discharged to the flow passage 44.

The second-stage compressed working fluid supply line L3 has one end connected to the flow passage 44 and the other end connected to a place of use (not illustrated) of the second-stage compressed working fluid. The second-stage compressed working fluid discharged to the flow passage 44 is supplied to the place of use through the second-stage compressed working fluid supply line L3.

The working fluid supply line L4 has one end connected to the second penetration portion 66 and the other end branching off into a plurality of portions. A working fluid under compression is supplied to the thrust bearing 18, the radial bearings 19 and 21, and the rotation drive portion 15 through the working fluid supply line L4. Accordingly, the rotation drive portion 15 is cooled by the working fluid under compression. The working fluid under compression is a working fluid having a lower pressure and a lower temperature than the first-stage compressed working fluid.

Since the aforementioned working fluid gas extraction portion 34 and the working fluid supply line L4 are included, it is possible to use a working fluid under compression having a lower pressure and a lower temperature than the first-stage compressed working fluid of which compression is completed by the first-stage impeller 26 as a working fluid for cooling the rotation drive portion 15. Accordingly, since it is possible to make the amount of a working fluid necessary for cooling the rotation drive portion 15 (the working fluid under compression) smaller than a case where the first-stage compressed working fluid is used, the rotation drive portion 15 can be efficiently cooled.

In a case where, for example, working fluid bearings are used as the thrust bearing 18 and the radial bearings 19 and 21, a working fluid under compression can be used as a working fluid by supplying the working fluid under compression to the thrust bearing 18 and the radial bearings 19 and 21.

On the other hand, in a case where, for example, magnetic bearings or oil bearings are used as the thrust bearing 18 and the radial bearings 19 and 21, the thrust bearing 18 and the radial bearings 19 and 21 can be cooled with the use of a working fluid under compression.

The working fluid collection line L5 has one end branching off into a plurality of portions, and a working fluid under compression used in cooling or in cooling and as a working fluid is collected therethrough from the thrust bearing 18, the radial bearings 19 and 21, and the rotation drive portion 15.

The pressure of the working fluid under compression supplied to the thrust bearing 18, the radial bearings 19 and 21, and the rotation drive portion 15 slightly decreases by the working fluid under compression functioning as a coolant and a working fluid. However, since the pressure decrease is slight, the pressure of the working fluid under compression that is in a state where the pressure thereof has decreased is higher than the pressure of a working fluid supplied from the working fluid supply source (not illustrated) (a working fluid that is not compressed).

The other end of the working fluid collection line L5 is connected to the working fluid supply line for impeller L1. The working fluid collection line L5 allows the working fluid under compression of which a pressure has slightly decreased to be supplied therethrough to the space 45A via the working fluid supply line for impeller L1 by the working fluid under compression functioning as a coolant and a working fluid. As described above, the pressure of the working fluid under compression that is in a state where the pressure thereof has decreased is higher than the pressure of a working fluid supplied from the working fluid supply source (not illustrated) (a working fluid that is not compressed).

Therefore, it is possible to supply the collected working fluid under compression to the space 45A by simply connecting the working fluid collection line L5 to the working fluid supply line for impeller L1 without making the pressure of the collected working fluid under compression higher than the pressure of the working fluid that is supplied from the working fluid supply source (not illustrated) and is not compressed. Accordingly, it is not necessary to provide an additional pressure-boosting device for increasing the pressure of the collected working fluid in the working fluid collection line L5. Therefore, the collected working fluid under compression can be reused in order to suppress a cost increase.

In addition, since the temperature of a working fluid under compression on which gas extraction is performed from the middle of the first-stage impeller 26 is low compared to a compressed working fluid of which compression is completed by the first-stage impeller 26, it is possible to make the amount of a working fluid necessary for cooling the rotation drive portion 15 small. Accordingly, the amount of the working fluid to be collected through the working fluid collection line L5 is small. Therefore, since it is possible to make the amount of the working fluid to be compressed by the first-stage impeller 26 and the second-stage impeller 32 small, the power of the first-stage impeller 26 and the second-stage impeller 32 can be made small.

Cooling the rotation drive portion 15 with the use of a working fluid that is not compressed, instead of a working fluid under compression, is also considered. In this case, however, the pressure of a collected working fluid that is not compressed is even lower than the pressure of a working fluid supplied to the first-stage impeller 26.

For this reason, in a case where a working fluid supply line L5 is connected to the working fluid supply line for impeller L1, it is necessary to provide an additional pressure-boosting device that increases the pressure of a working fluid collected through the working fluid supply line L5. Therefore, since using a working fluid that is not compressed in cooling the rotation drive portion 15 leads to a cost increase, the case described above is not preferable.

Since the seal portions 27 and 28 defining the ring-shaped gap 62 and the working fluid supply line L4 are included in the rotary machine of the first embodiment, it is possible to supply a working fluid under compression on which gas extraction is performed by the working fluid gas extraction portion 34 (a working fluid having a lower pressure and a lower temperature than the first-stage compressed working fluid of which compression is completed by the first-stage impeller 26) to the rotation drive portion 15 via the working fluid supply line L4 and to use the working fluid under compression as a working fluid for cooling. Accordingly, since it is possible to make the amount of a working fluid necessary for cooling the rotation drive portion 15 smaller than a case where the first-stage compressed working fluid is used, the rotation drive portion 15 can be efficiently cooled.

Although a case where the impellers are disposed at both end portions of the rotary shaft 12 is described as an example in the first embodiment, the invention is also applicable to a rotary machine in which the plurality of impellers are disposed in the axis $O_1$-direction of the rotary shaft 12. In this case, the working fluid gas extraction portion 34 may be provided on a side of the first-stage impeller that initially compresses a working fluid, out of the plurality of impellers.

In addition, although a case where the two seal portions 27 and 28 are disposed in the gap 60 and the gap 62 is defined is described as an example in the first embodiment, three or more seal portions may be disposed in a state of being spaced apart from each other in the gap 60, and the first penetration portion may be provided such that it is possible to perform gas extraction on a working fluid under compression from each gap defined between the seal portions adjacent to each other.

Since it is possible to acquire a plurality of working fluids under compression having lower pressures than the first-stage compressed working fluid and different pressures from each other by configuring in this manner, it is effective in a case where the plurality of working fluids under compression having different pressures are intended to be used.

Second Embodiment

Figure 4:
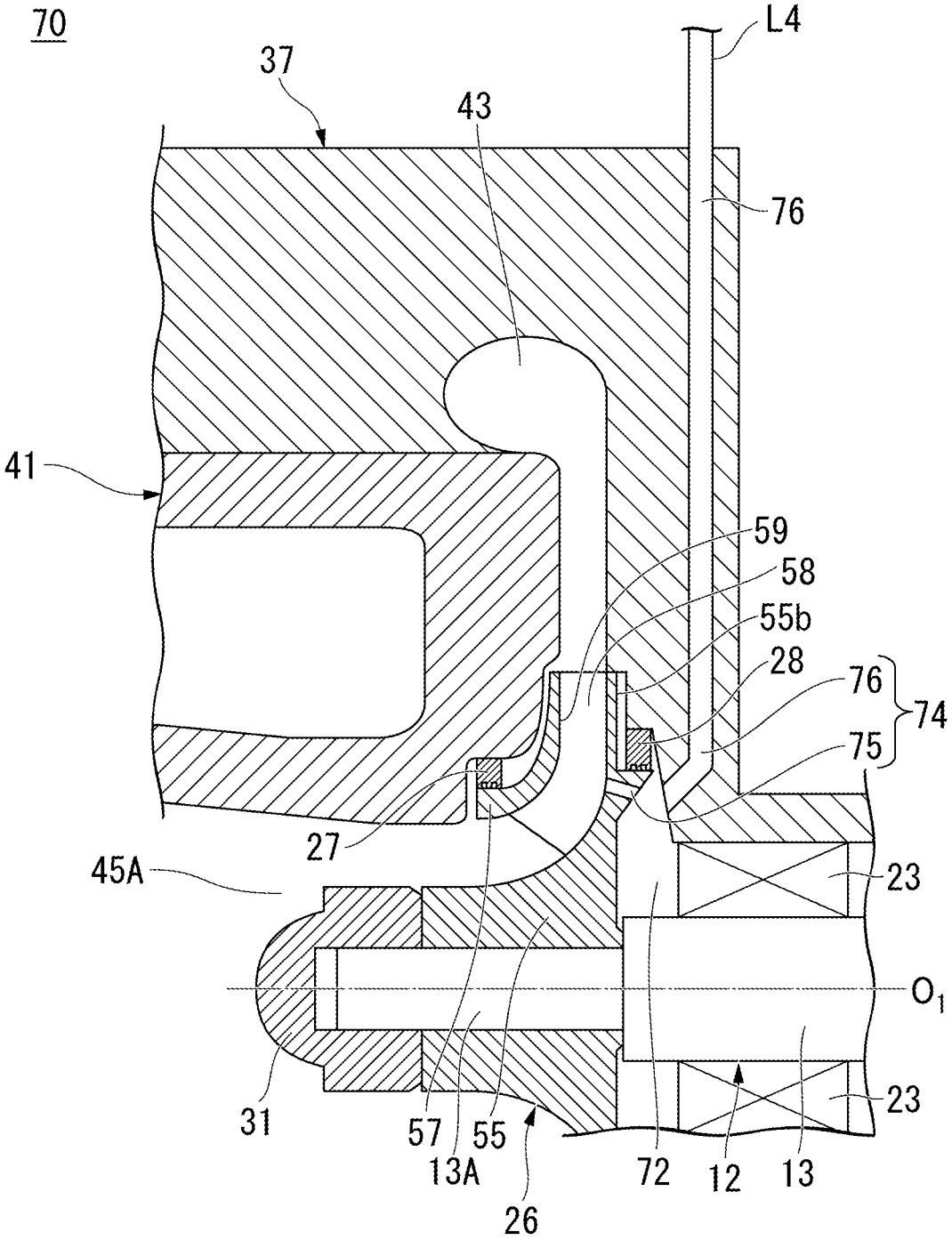
FIG. 4 is an enlarged sectional view of main portions of a rotary machine according to a second embodiment of the present invention.

FIG. 4 is an enlarged sectional view of main portions of a rotary machine according to a second embodiment of the present invention. In FIG. 4, the same configuring portions as the structures illustrated in FIGS. 1 to 3 are assigned with the same reference signs.

A rotary machine 70 of the second embodiment will be described with reference to FIG. 4. The rotary machine 70 of the second embodiment is configured the same as the rotary machine 10 of the first embodiment except that the position where the seal portion 28 is provided is changed and a working fluid gas extraction portion 74 is included instead of the working fluid gas extraction portion 34.

The seal portion 28 is provided on the disk portion 55 between a portion positioned on a second surface 55*b* side and the second casing portion 37. A ring-shaped space 72 is defined between the seal portion 28 and the shaft seal member 23.

The working fluid gas extraction portion 74 has a first penetration portion 75 and a second penetration portion 76. The first penetration portion 75 is provided to penetrate a position where gas extraction can be performed on a working fluid under compression in the disk portion 55. The first penetration portion 75 has one end that communicates with the flow passages 59 and the other end that communicates with the space 72.

It is possible to dispose the first penetration portion 75, for example, in a portion corresponding to a middle position in the blade portions 58 in the working fluid flowing direction. The first penetration portion 75 may be provided, for example, with respect to each of the plurality of flow passages 59. The first penetration portion 75 performs gas extraction on a working fluid under compression from the first-stage impeller 26, and leads the working fluid under compression on which gas extraction is performed to the space 72.

It is possible to use, for example, a through-hole as the first penetration portion 75. In a case where a through-hole extending in a predetermined direction is used as the first penetration portion 75, an extension direction of the through-hole may be a direction parallel to the axis $O_1$, or may be a direction inclined to the axis $O_1$ (an intersecting direction).

The second penetration portion 76 is provided to penetrate the second casing portion 37. The second penetration portion 76 has one end that communicates with the space 72 and the other end connected to the working fluid supply line L4. The second penetration portion 76 allows a working fluid under compression, on which gas extraction is performed in the space 72, to be supplied to the working fluid supply line L4. It is possible to use, for example, a through-path (a through-flow passage) as the second penetration portion 76.

Since the seal portion 28 and the shaft seal member 23, which define a ring-shaped space, the working fluid gas extraction portion 74 having the first and second penetration portions 75 and 76, and the working fluid supply line L4 connected to the second penetration portion 76 are included in the rotary machine 70 of the second embodiment, it is possible to supply a working fluid under compression on which gas extraction is performed by the working fluid gas extraction portion 74 (a working fluid having a lower pressure and a lower temperature than the first-stage compressed working fluid of which compression is completed by the first-stage impeller 26) to the rotation drive portion 15 via the working fluid supply line L4 and to use the working fluid under compression as a working fluid for cooling. Accordingly, since it is possible to make the amount of a working fluid necessary for cooling the rotation drive portion 15 smaller than a case where the first-stage compressed working fluid is used, the rotation drive portion 15 can be efficiently cooled.

That is, a working fluid under compression may undergo gas extraction from a shroud portion 57 side of the first-stage impeller 26 as described in the first embodiment, or may undergo gas extraction from a side of the disk portion 55 positioned on an opposite side to the shroud portion 57 as described in the second embodiment.

The shapes and formed positions of the first and second penetration portions 75 and 76 illustrated in FIG. 4 are merely examples, and are not limited to the shapes and formed positions illustrated in FIG. 4.

In addition, although a case where the impellers are disposed at both end portions of the rotary shaft 12 is described as an example in the second embodiment, the invention is also applicable to a rotary machine in which the plurality of impellers are disposed in the axis $O_1$-direction of the rotary shaft 12. In this case, the working fluid gas extraction portion 74 may be provided on the first-stage impeller, out of the plurality of impellers.

In addition, for example, the plurality of seal portion 28 may be provided between the second surface 55*b* side of the disk portion 55 and the second casing portion 37, and the first penetration portion may be provided in each gap defined between the seal portions 28 adjacent to each other such that gas extraction can be performed on a working fluid under compression. Since it is possible to acquire a plurality of working fluids under compression having lower pressures than the first-stage compressed working fluid and different pressures from each other by configuring in this manner, it is effective in a case where the plurality of different working fluids under compression are intended to be used.

INDUSTRIAL APPLICABILITY

The rotary machine of the present invention is applicable to a compressor, a turbine, or the like.

REFERENCE SIGNS LIST

10, 70: Rotary Machine
11: Casing
12: Rotary Shaft
13: Rotary Shaft Main Body
13*a*: Outer Circumferential Surface
14: Thrust Collar
18: Thrust Bearing
13*a*: One End Portion
13*b*: The Other End Portion
15: Rotation Drive Portion
16, 17: Bearing-Supporting Member
16*a*: Ring-Shaped Accommodation Portion
16*b*: Ring-Shaped Hollow Portion
17*a*, 36*a*: Inner Circumferential Surface

18: Thrust Bearing
19, 21: Radial Bearing
23, 24: Shaft Seal Member
26: First-Stage Impeller
27, 28: Seal Portion
31, 33: Position-Regulating Portion
32: Second-Stage Impeller
34, 74: Working Fluid Gas Extraction Portion
36: First Casing Portion
36*a*: First Flange Portion
36*b*: Second Flange Portion
37, 38: Second Casing Portion
37*a*, 38*a*: Opening Portion
41, 42: Third Casing Portion
43, 44, 59: Flow Passage
45: First Working Fluid-Introducing Portion
45*a*, 48*a*, 72: Space
46, 49: Supporting Portion
48: Second Working Fluid-Introducing Portion
51: Rotor
52: Stator
55: Disk Portion
55*a*: First Surface
55*b*: Second Surface
55*a*: Through-Hole
57: Shroud Portion
58: Blade Portion
60, 62: Gap
65, 75: First Penetration Portion
66, 76: Second Penetration Portion
A: Region
L1: Working Fluid Supply Line for An Impeller
L2: First-Stage Compressed Working Fluid Supply Line
L3: Second-Stage Compressed Working Fluid Supply Line
L4: Working Fluid Supply Line
L5: Working Fluid Collection Line
$O_1$: Axis
X, $X_1$, $X_2$: Direction

The invention claimed is:

1. A rotary machine, comprising:
a bearing configured to rotatably support a rotary shaft;
a rotation drive portion configured to rotate the rotary shaft;
an impeller that is provided on the rotary shaft, and configured to be rotated about an axis of the rotary shaft thereby compressing a working fluid flowing therein;
a casing accommodating the rotary shaft, the bearing, the rotation drive portion and the impeller;
a working fluid gas extraction portion configured to extract the working fluid under compression from a middle of the impeller to an outside of the casing; and
a working fluid supply line configured to allow the working fluid under compression, on which gas extraction is performed by the working fluid gas extraction portion, to be supplied therethrough to the rotation drive portion,
wherein the impeller includes a disk portion fixed to the rotary shaft, a plurality of blade portions that are arranged in a circumferential direction of the disk portion and are erected on the disk portion, and a shroud portion covering the plurality of blade portions and opposes an inner surface of the casing,
a plurality of seal portions are provided between the shroud portion and the inner surface of the casing so as to be arranged to be spaced apart from each other in a direction from the inlet toward an outlet of the impeller, and wherein
the working fluid gas extraction portion includes
a first penetration portion that is formed so as to penetrate the shroud portion to reach a gap formed between the two seal portions adjacent to each other, and
a second penetration portion that is formed so as to penetrate the casing to reach the gap, and is connected to the working fluid supply line.

2. The rotary machine according to claim 1, wherein
the gap is a ring-shaped surrounding the rotary shaft,
a plurality of flow passages are formed by defining spaces between the shroud portion and the disk portion by the plurality of blade portions in a circumferential direction of the rotary shaft, and
the first penetration portion is provided with respect to each of the plurality of flow passages.

3. The rotary machine according to claim 1, further comprising:
a working fluid supply line for an impeller configured to allow the working fluid to be supplied therethrough to an inlet of the impeller; and
a working fluid recovery line that is connected to the working fluid supply line for an impeller, the working fluid under compression, which is supplied through the working fluid supply line, is allowed to be recovered through the working fluid recovery line, and the working fluid under compression, which is supplied to the rotation drive portion through the working fluid supply line for an impeller, is allowed to be supplied to the inlet of the impeller through the working fluid recovery line.

4. The rotary machine according to claim 1, wherein
a plurality of the impellers are provided in an axis direction of the rotary shaft, and
the working fluid under compression is extracted by the working fluid gas extraction portion from a first-stage impeller that initially compressing the working fluid, out of the plurality of impellers.

5. The rotary machine according to claim 1, wherein
the bearing is a working fluid bearing, and
the working fluid under compression is allowed to be supplied to the working fluid bearing through the working fluid supply line.

6. The rotary machine according to claim 1, wherein
the bearing is a magnetic bearing, and
the working fluid under compression is allowed to be supplied to the magnetic bearing through the working fluid supply line.

7. A rotary machine, comprising:
a bearing configured to rotatably support a rotary shaft;
a rotation drive portion configured to rotate the rotary shaft;
an impeller that is provided on the rotary shaft, and configured to be rotated about an axis of the rotary shaft thereby compressing a working fluid flowing therein;
a casing accommodating the rotary shaft, the bearing, the rotation drive portion and the impeller;
a working fluid gas extraction portion configured to extract the working fluid under compression from a middle of the impeller to an outside of the casing; and
a working fluid supply line configured to allow the working fluid under compression, on which gas extraction is performed by the working fluid gas extraction portion, to be supplied therethrough to the rotation drive portion, wherein the impeller includes a disk portion fixed to the rotary shaft, a plurality of blade portions that are arranged in a circumferential direction of the disk portion and are erected on a first surface of the disk portion, and a shroud portion covering the plurality of blade portions so as to oppose an inner surface of the casing, the rotary machine further comprises a shaft seal member that is provided between the rotary shaft and the casing so as to be disposed on a disk side of an axis direction of the rotary shaft with respect to the impeller, and a seal portion that is provided between the disk portion and the casing so as to form a space between the shaft seal member and the seal portion, and wherein the working fluid gas extraction portion includes a first penetration portion that is formed so as to penetrate the disk portion to reach the space, and a second penetration portion that is formed so as to penetrate the casing to reach the space, and is connected to the working fluid supply line.

8. The rotary machine according to claim 7, wherein the space is a ring-shaped surrounding the rotary shaft, a plurality of flow passages arranged in the circumferential direction of the rotary shaft are defined by the plurality of blade portions, and the first penetration portion is provided with respect to each of the plurality of flow passages.

9. The rotary machine according to claim 8, further comprising:

a working fluid supply line for an impeller configured to allow the working fluid to be supplied therethrough to an inlet of the impeller; and a working fluid recovery line that is connected to the working fluid supply line for an impeller, the working fluid under compression, which is supplied through the working fluid supply line, is allowed to be recovered through the working fluid recovery line, and the working fluid under compression, which is supplied to the rotation drive portion through the working fluid supply line for an impeller, is allowed to be supplied to the inlet of the impeller through the working fluid recovery line.

10. The rotary machine according to claim 8, wherein a plurality of the impellers are provided in an axis direction of the rotary shaft, and the working fluid under compression is extracted by the working fluid gas extraction portion from a first-stage impeller that initially compressing the working fluid, out of the plurality of impellers.

11. The rotary machine according to claim 8, wherein the bearing is a working fluid bearing, and the working fluid under compression is allowed to be supplied to the working fluid bearing through the working fluid supply line.

12. The rotary machine according to claim 8, wherein the bearing is a magnetic bearing, and the working fluid under compression is allowed to be supplied to the magnetic bearing through the working fluid supply line.

* * * * *